United States Patent [19]

Zimmermann et al.

[11] Patent Number: 4,700,397

[45] Date of Patent: Oct. 13, 1987

[54] SURVEILLANCE MICROPHONE HOLDER

[75] Inventors: Philip A. Zimmermann, Concord; William B. Van Lennep, Pepperell, both of Mass.

[73] Assignee: Controlonics Corporation, Westford, Mass.

[21] Appl. No.: 808,887

[22] Filed: Dec. 13, 1985

[51] Int. Cl.[4] ..... H04R 1/02

[52] U.S. Cl. ..... 381/169; 381/187

[58] Field of Search ..... 381/91, 67, 68, 69, 381/169, 187; 179/157, 146 H, 107 R; 455/100

[56] References Cited

U.S. PATENT DOCUMENTS 2,958,740 11/1960 Kirk ..... 179/157

4,607,383 8/1986 Ingalls ..... 179/157

*Primary Examiner*—Gene Z. Rubinson

*Assistant Examiner*—L. C. Schroeder

*Attorney, Agent, or Firm*—Weingarten, Schurgin, Gagnebin & Hayes

[57] ABSTRACT

A microphone holder for surveillance work and adapted to support a microphone in a concealed position when the holder is taped to the upper torso of a surveillance agent and to avoid clothing rustle and bulges resulting from the normal wear of the holder. The holder is of a flexible rubber material capable of moving with the wearer to permit comfortable use and avoid detection by persons under surveillance. The holder has an upper surface of a generally convex shape and a lower surface which is nearly flat but slightly concave. The upper surface is provided with a recess for the retention of a small microphone that can be un-encased and recessed below the upper surface to avoid clothing rustle. Microphone leads are kept below the upper surface in a groove to further avoid a detectable impression through the clothing of a wearer. Recording means which may include transmitting means is typically located elsewhere on the wearer.

17 Claims, 5 Drawing Figures

FIG. 1
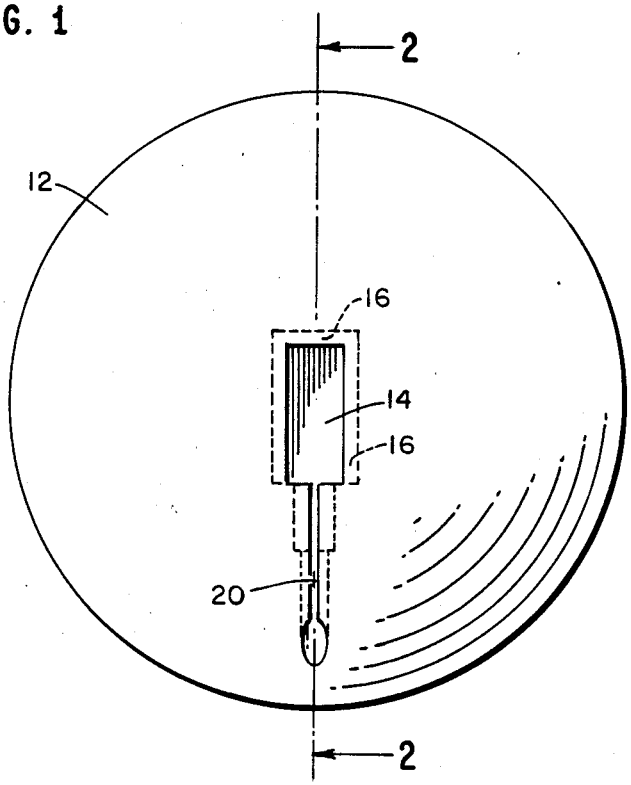
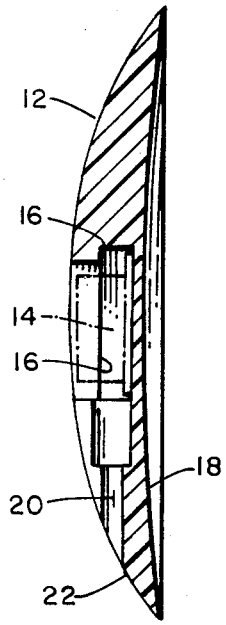
FIG. 2
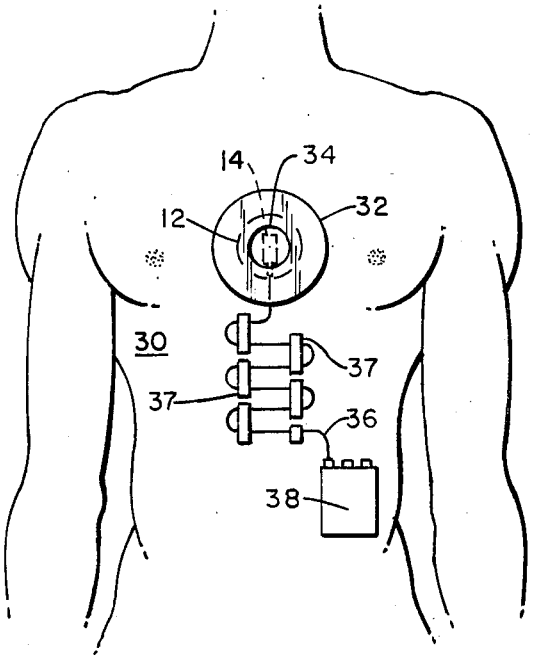
FIG. 3
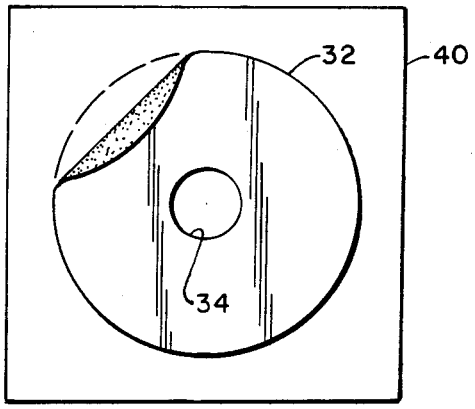
FIG. 4
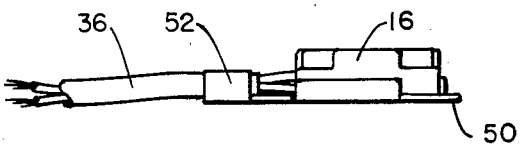
FIG. 5

SURVEILLANCE MICROPHONE HOLDER

FIELD AND BACKGROUND OF THE INVENTION

The present invention relates to surveillance microphones and means for holding them about the body of a surveillance agent. Such microphones are commonly used by enforcement or other government agents when it is necessary to gather information on persons believed to be engaged in illegal, or associated with illegal activities. Two primary concerns enter into the use of such microphones; one, the avoidance of detection by the person under surveillance that the wearer is wired to record a conversation; and two, the assurance that the reception of any conversation or other auditory information is as clear and intelligible as is possible to insure its later envidentiary value.

The former requires that the microphone be worn by the agent in a comfortable manner so that there is no tendency to twitch or act otherwise in a suspicious manner. It is further necessary that the microphone not be visible through the clothing of the agent or create a telltale bulge in the user's garments.

The latter necessitates that the microphone be made immune to noise interference such as produced by rustling of the user's clothing over the microphone.

BRIEF SUMMARY

In accordance with the teaching of the present invention a microphone support system is provided which permits the concealment of a surveillance microphone on the upper torse or other body locations of a surveillance agent in a manner that facilitates use, insures security of concealment and avoids the clothing rustle that impairs reliable voice recording while at the same time positioning the microphone to reliably and accurately respond to voices in front of the agent.

In particular, the support system comprises a microphone holder that is formed of a flexible rubber material in a disk shape. The disk shaped holder has an upper convex surface and a lower substantially flat surface. The upper surface has an aperture through it to an inner recess that holds a microphone element. The microphone element is supported in the recess below the upper surface so that clothing rustle is not directly applied across the microphone element itself. A cable for the microphone is led through a channel in the holder to a point near the periphery of the disk shaped holder to insure no irregularilty appears through the agent's clothing to give a clue to the presence of the surveillance microphone. The cable is then preferably taped to the torso in a serpentine pattern to provide strain relief.

A disk shaped adhesive layer of diameter larger than the disk shaped holder is applied to the holder with the outer edges beyond the holder adhered to the torso skin, securing the entire system to the torso. To facilitate use, the holder is in a kit with a backing or release sheet provided with the disk-shaped adhesive layer thereon.

DESCRIPTION OF THE DRAWING

These and other features of the invention are more fully described below in the solely exemplary detailed description and accompanying drawing of which:

FIG. 1 is a top view of a surveillance microphone holder according to the teaching of the invention;

FIG. 2 is side sectional view of the holder of FIG. 1;

FIG. 3 is an illustration of the holder of the invention in use on the torso of a surveillance agent; and FIG. 4 illustrates the typical form in which the securing tape is provided to the agent to facilitate use.

FIG. 5 illustrates a strain relief for the microphone of the present invention.

DETAILED DESCRIPTION

The present invention contemplates a holder for a surveillance microphone that insures security of concealment while promoting clear and noise free reception of voices to be recorded.

In particular, with reference to FIGS. 1 nd 2, there is shown a disk shaped holder body 12 of approximately two inch diameter, and formed of a soft and flexible plastic material such as a silicone rubber. The holder body material is largely immune to the generation of noise from flexing or from the slippage of clothing or other elements past or over it. The material of the body 12 of the holder is of a material which is preferably translucent and of a coloration such that when applied against the torso of the agent it blends in color with the skin color.

The holder body 12 has an upper surface 22 of a generally convex form, typically a spheric section. A lower surface 18 is substantially flat. In another embodiment the lower surface may be the convex surface with the upper surface flat.

The upper surface 22 has a recess 14, typically 3/16 by 7/16 inch and accessible through an aperture in the upper surface and adapted to secure a microphone 16 within the recess and below the upper surface 22. The microphone is preferrable un-encased, meaning that the sound responsive element is exposed to the environment, without an overlying covering. Miniature microphones of such design are readily available in the art.

The leads to the microphone are guided to the recess 14 through a channel 20 which is nearly covered at the surface 22 to prevent the bump of the leads from showing through covering clothing worn by the agent.

The body 12 of the holder is shown against the upper torso of an agent or other operative 30 in FIG. 3. To secure the body 12 of the holder in place, a piece of adhesive tape 32 of disk shape is applied over the body 12; and is of greater diameter than the body 12 so that the peripheral edges will stick to the agent's skin in areas around the body 12. The adhesive tape 32 is also translucent of a coloration that avoids any artificial appearance when affixed to the torso 30. The tape 32 has an aperture 34 aligned with the recess 14 so that there is no blockage of audio from reaching the microphone 16. In another embodiment, the tape is adapted for adhesion to the lower surface of the body 12 on the one hand and to the users torso on the other.

The microphone is connected by a lead 36 to a recording or transmitting device 38. Preferably the lead 36 is adhered to the torso 30 in a serpentine pattern by tape 37 to provide strain relief in the lead 36.

To facilitate the agent's use of the holder of the present invention it is provided in a kit along with needed adhesive tape and hair removal razor. The adhesive tape 32 is adhered to a backing sheet 40 as shown in FIG. 4.

The kit may include plural microphones and the device 38 may be adapted to receive two or more inputs from the corresponding plural microphones placed about the wearer to provide directional information.

By reference to FIG. 5, the microphone element 16 is shown bonded to a flanged strain relief 50 which secures the cable 36 by way of crimped ears 52 to the microphone element 16. The flange on the strain relief further facilitates securing the element 16 in the recess of the holder.

The surveillance microphone holding system described above provides a reliable and secure surveillance tool. Other forms of the invention may be realized within the scope of the invention as solely defined in the following claims.

What is claimed is:

1. A microphone holder for concealed wear about a body comprising:

a flexible disk shaped body having an upper surface and a lower surface;

said flexible disk shaped body having a recess in said upper surface adapted in size and shape to receive a microphone, and wherein said recess opens to said upper surface in opposed relation to the body;

means associated with said recess in said upper surface of said flexible disk shaped body for retaining the microphone within said recess; and said retaining means operative in association with the microphone to place the microphone below said upper surface whereby clothing rustle is avoided across the microphone.

2. The holder of claim 1 wherein said flexible disk shaped body further includes a channel leading from said recess in said upper surface toward a peripheral region of the body and wherein said channel is adapted for positioning a cable to cooperate with the microphone.

3. The holder of claim 1 further including adhesive means cooperating with said flexible disk shaped body for fastening said holder to the body of a surveillance operative.

4. The holder of claim 3 wherein said adhesive means is a disk shaped tape having a diameter larger than a diameter of said flexible disk shaped body and wherein said disk shaped tape is applied to said flexible disk shaped body to fasten said holder to the body of the surveillance operative.

5. The holder of claim 1 further including a microphone element inserted into said recess in said upper surface of said flexible disk shaped body.

6. The holder of claim 1 wherein said flexible disk shaped body is fabricated of a rubber material.

7. The holder of claim 1 wherein said flexible disk shaped body is fabricated of a silicone rubber material.

8. The holder of claim 1 wherein said flexible disk shaped body is approximately two inches in diameter.

9. The holder of claim 1 wherein said flexible disk shaped body includes an aperture in said upper surface and wherein said aperture is coterminous with said recess.

10. The holder of claim 1 wherein said lower surface is flat.

11. The holder of claim 1 further including a wire lead for the microphone retained within said recess and wherein the wire lead is adhered to the body of a wearer in a serpentine pattern.

12. The holder of claim 11 further including recording means connected to the wire lead.

13. The holder of claim 1 wherein said flexible disk shaped body is of a coloration substantially the same as the body, thereby blending with the body for concealed wear.

14. A plurality of said holders of claim 12 wherein said recording means includes means for receiving plural cables from plural microphones retained within respective ones of said plurality of said holders.

15. The holder of claim 1 wherein said upper surface is convex and said lower surface is flat.

16. The holder of claim 1 wherein said lower surface is convex and said upper surface is flat.

17. The holder of claim 3 wherein said adhesive means is adapted for adhesion to said lower surface of said flexible disk shaped body.

* * * * *